US006055731A

United States Patent [19]

Zucker

[11] Patent Number: 6,055,731

[45] Date of Patent: May 2, 2000

[54] RAZOR WITH CONVEX BLADE ASSEMBLY

[75] Inventor: Shlomo Zucker, Mihmoret, Israel

[73] Assignee: Wheel Technology Ltd., Georgetown, Cayman Islands

[21] Appl. No.: 09/219,372

[22] Filed: Dec. 23, 1998

[51] Int. Cl.[7] ..... B26B 21/20

[52] U.S. Cl. ..... 30/49; 30/34.2

[58] Field of Search ..... 30/49, 34.2, 77, 30/29.3, 346.57, 50

[56] References Cited

U.S. PATENT DOCUMENTS

| | | | |
|---|---|---|---|
| 1,226,614 | 5/1917 | Hiskey | 30/49 |
| 2,501,987 | 3/1950 | Brown | 30/49 X |
| 3,802,072 | 4/1974 | Wintercorn . | |
| 3,889,372 | 6/1975 | Sakai et al. . | |
| 4,031,618 | 6/1977 | Mansfield . | |
| 4,344,227 | 8/1982 | Chen et al. . | |
| 4,493,149 | 1/1985 | Tanashashi et al. . | |
| 4,884,338 | 12/1989 | Stewart . | |
| 5,673,485 | 10/1997 | Hill . | |

*Primary Examiner*—Douglas D. Watts
*Attorney, Agent, or Firm*—Mark M. Friedman

[57] ABSTRACT

A blade assembly for use in a razor has at least one blade providing a cutting edge, a leading skin guide located ahead of the cutting edge, and a trailing skin guide located behind the cutting edge. The leading and trailing skin guides are configured to provide one or more front contact surface and one or more rear contact surface, respectively, for contacting the skin of a user. These front and rear contact surfaces lie substantially on a virtual convexly-curved contact profile such that, when the blade assembly is pressed against the skin of a user, the skin becomes stretched to conform to the contact profile.

13 Claims, 7 Drawing Sheets

RAZOR WITH CONVEX BLADE ASSEMBLY

FIELD AND BACKGROUND OF THE INVENTION

The present invention relates to manual razors and, in particular, it concerns a razor having a convex blade assembly.

It is known to provide a safety blade configuration for manual shaving. A safety blade configuration is a structure in which leading and trailing skin contact surfaces define the position of one or more blades relative to the skin surface such that the blades cannot cut into the skin during shaving. Specifically, the leading and trailing surfaces are generally coplanar, the cutting edge being set at a level even with, or just below, this plane.

It is also known that slight tension applied to the surface of the skin in the direction of shaving greatly improves the quality of shave by helping to erect the hairs. Many razor designs are intended to produce such an effect, including the Gillette II®. Attempts to further improve this effect have included designs with various textured strips and the like. However, these cause increased friction with the skin, leading to possible irritation.

There is therefore a need for a razor which would enhance the shaving action by stretching the skin of the user without causing increased friction with the skin.

SUMMARY OF THE INVENTION

The present invention is a razor employing a convex blade assembly.

According to the teachings of the present invention there is provided, a razor for shaving hair from the skin of a user, the razor comprising a blade assembly including: (a) at least one blade having a cutting edge; (b) a leading skin guide located ahead of the cutting edge, the leading skin guide being configured to provide at least one front contact surface for contacting the skin of a user; and (c) a trailing skin guide located behind the cutting edge, the trailing skin guide being configured to provide at least one rear contact surface for contacting the skin of a user, wherein the front contact surface and the rear contact surface lie substantially on a virtual convexly-curved contact profile such that, when the blade assembly is pressed against the skin of the user, the skin becomes stretched at least in a region adjacent to the cutting edge to conform to the contact profile.

According to a further feature of the present invention, the virtual convexly-curved contact profile corresponds to at least part of a virtual cylinder. The virtual cylinder preferably has a radius of between about 4 mm and about 30 mm.

According to a further feature of the present invention, the at least part of the virtual cylinder corresponds to an angular extent of at least about 30°, and preferably at least about 45°.

According to a further feature of the present invention, the at least one blade is implemented as at least a first blade and a second blade, the blade assembly further including an intermediate skin guide located between the first blade and the second blade, the intermediate skin guide being configured to provide at least one intermediate contact surface lying on the virtual convexly-curved contact profile for contacting the skin of a user.

According to a further feature of the present invention, a tangent to the virtual convexly-curved contact profile taken adjacent to the cutting edge of the first blade defines a first cutting direction and a tangent to the virtual convexly-curved contact profile taken adjacent to the cutting edge of the second blade defines a second cutting direction, the second cutting direction being rotated by at least about 15° from the first cutting direction.

According to a further feature of the present invention, the leading skin guide is configured to provide a plurality of the front contact surfaces implemented as front contact ridges substantially adjacent to, and spaced along a length of, the cutting edge.

According to a further feature of the present invention, the at least one blade is implemented as at least a first blade and a second blade, the blade assembly further including an intermediate skin guide located between the first blade and the second blade, the intermediate skin guide being configured to provide a plurality of intermediate contact ridges substantially adjacent to, and spaced along a length of, the cutting edge of the second blade, wherein positions of the intermediate contact ridges are staggered relative to positions of the front contact ridges.

According to a further feature of the present invention, the blade assembly is formed with at least one drainage channel formed between the at least one blade and at least one of the leading skin guide and the trailing skin guide.

According to a further feature of the present invention, there is also provided a handle, wherein the blade assembly is implemented as a removable cartridge configured for attachment to the handle.

According to a further feature of the present invention, the blade assembly is implemented as a two sided blade assembly having an anterior side and a posterior side, the at least one blade, the leading skin guide and the trailing skin guide being referred to, respectively, as the at least one anterior blade, the anterior leading skin guide and the anterior trailing skin guide, the blade assembly further including: (a) at least one posterior blade having a cutting edge; (b) a posterior leading skin guide located ahead of the cutting edge, the posterior leading skin guide being configured to provide at least one front contact surface for contacting the skin of a user; and (c) a posterior trailing skin guide located behind the cutting edge, the posterior trailing skin guide being configured to provide at least one rear contact surface for contacting the skin of a user, wherein the front contact surface and the rear contact surface lie on a virtual convexly-curved contact profile such that, when the posterior side of the blade assembly is pressed against the skin of the user, the skin becomes stretched to conform to the contact profile.

There is also provided according to a further feature of the present invention, a method for constructing a razor for shaving hair from the skin of a user such that the razor is insensitive to variations in a holding angle at which it is held relative to the skin, the method comprising providing a blade assembly including: (a) at least one blade having a cutting edge; (b) a leading skin guide located ahead of the cutting edge, the leading skin guide being configured to provide at least one front contact surface for contacting the skin of a user; and (c) a trailing skin guide located behind the cutting edge, the trailing skin guide being configured to provide at least one rear contact surface for contacting the skin of a user, wherein the front contact surface and the rear contact surface lie substantially on, and span at least about 45° of, a virtual substantially cylindrical convex contact profile such that, when the blade assembly is pressed against the skin of the user, the skin conforms to the contact profile, thereby maintaining a correct shaving geometry over a range of holding angles.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a razor employing a convex blade assembly.

The principles and operation of razors according to the present invention may be better understood with reference to the drawings and the accompanying description.

Figure 1:
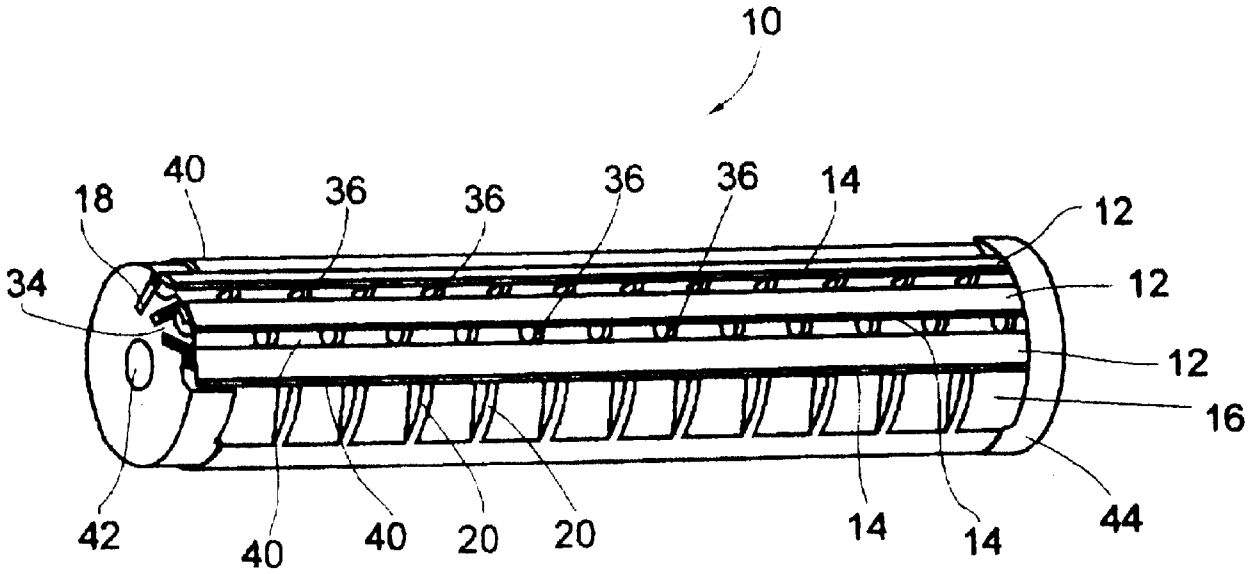
FIG. 1 is an isometric view of a blade assembly of a razor, constructed and operative according to the teachings of the present invention.
Figure 2:
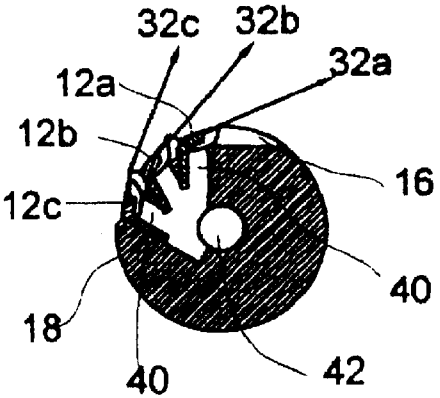
FIG. 2 is a cross-sectional view taken through the blade assembly of FIG. 1.
Figure 3:
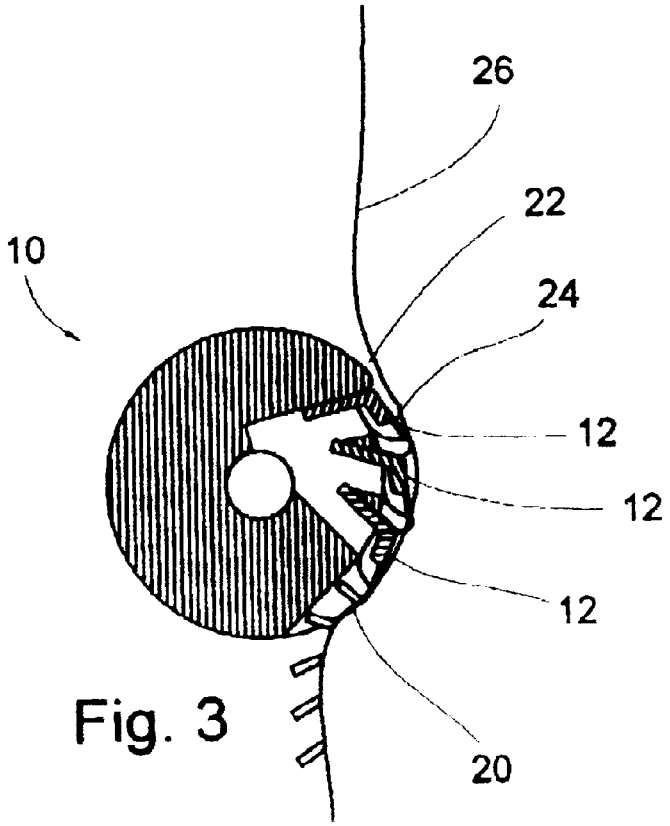
FIG. 3 is a schematic cross-sectional view of the blade assembly of FIG. 1 in use for shaving hair from the skin of a user.

Referring now to the drawings, FIGS. 1–3 show a blade assembly, generally designated 10, for use in a razor constructed and operative according to the teachings of the present invention. Generally speaking, blade assembly has at least one blade 12 providing a cutting edge 14, a leading skin guide 16 located ahead of cutting edge 14, and a trailing skin guide 18 located behind cutting edge 14. Skin guides 16 and 18 are configured to provide one or more front contact surface 20 and one or more rear contact surface 22, respectively, for contacting the skin of a user. These front and rear contact surfaces 20 and 22 lie substantially on a virtual convexly-curved contact profile 24 such that, when the blade assembly is pressed against the skin 26 of a user, the skin becomes stretched to conform to contact profile 24 (FIG. 3).

It will be appreciated that blade assembly 10 is effective to stretch the skin of the user, thereby erecting the hairs to improve the quality of shaving by employing the natural elasticity of the skin. Blade assembly 10 does not rely upon any frictional effects, thereby avoiding any unnecessary skin irritation.

Before turning to the features of blade assembly 10 in more detail, it will be helpful to define certain terms used to describe the geometry of various implementations of the present invention. For this purpose, reference will be made briefly to FIG. 8. Firstly, each blade 12 has a cutting edge 14 formed by grinding the blade at a given grinding angle. The cutting edge 14 is generally assumed to be linear, defining an extensional direction of the blade. The outer ground surface of the blade may be taken to define a grinding plane 30 passing through cutting edge 14.

Figure 8:
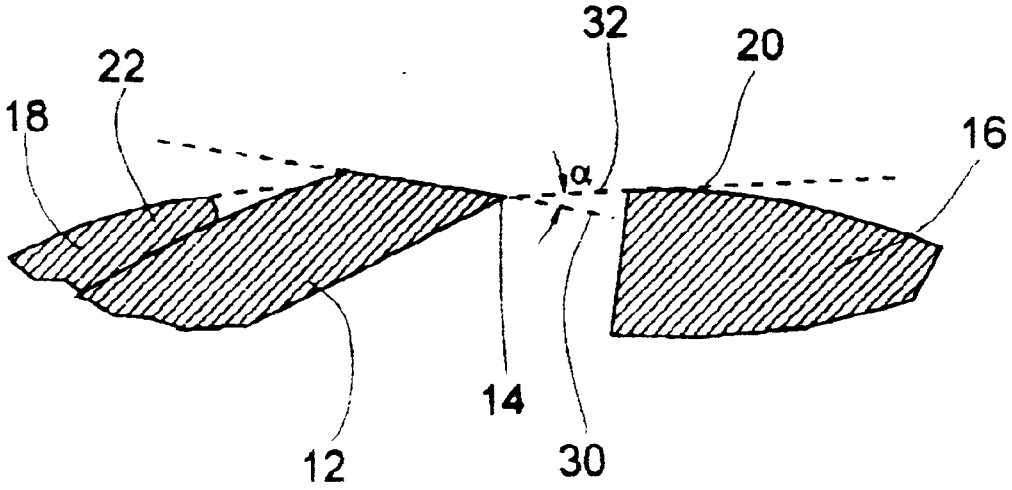
FIG. 8 is a schematic illustration of a preferred cutting geometry for use in the blade assembly of FIG. 6.

A second plane passing through cutting edge 14 is defined by the "cutting direction" 32 which is the direction of movement of the cutting edge relative to the skin of the user as dictated by the geometry of the skin contact surfaces around the blade. Specifically, the cutting direction 32 of a blade 12 may conveniently be identified as the tangent to virtual convexly-curved contact profile 24 taken adjacent to cutting edge 14. The plane containing the cutting edge 14 and parallel to the cutting direction 32 is termed the "cutting plane". An angle at between grinding plane 30 and cutting direction 32 is termed the "attack angle" of blade 12 in blade assembly 10 and, in the example illustrated in FIG. 8, is defined to be negative.

It should be noted that the terms such as "ahead of" or "leading" and "behind" or "trailing" are used to define spatial relations between certain elements or positions and a cutting edge 14 in the most general sense. Thus, an element or position is considered to be "ahead of" or "leading" the cutting edge if its orthogonal projection onto grinding plane 30 lies on the side of cutting edge 14 remote from the main body of blade 12, whereas all positions of which the orthogonal projection onto grinding plane 30 lie on the same side of cutting edge 14 as the body of blade 12 are termed "behind" or "trailing" the cutting edge.

Figure 14A:
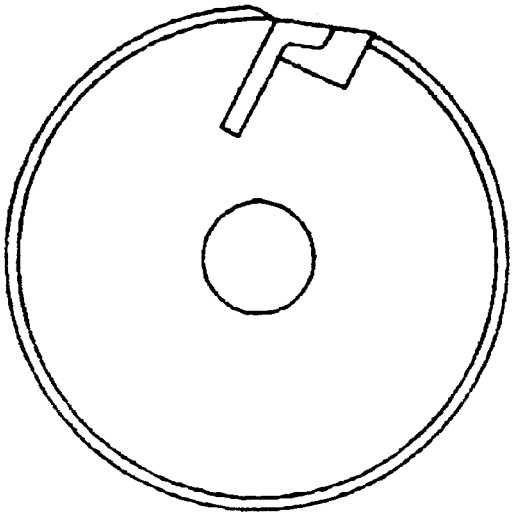
FIGS. 14A and 14B are schematic cross-sectional views taken through alternative implementations of the blade assembly of FIG. 1 employing one and two blades, respectively.
Figure 14B:
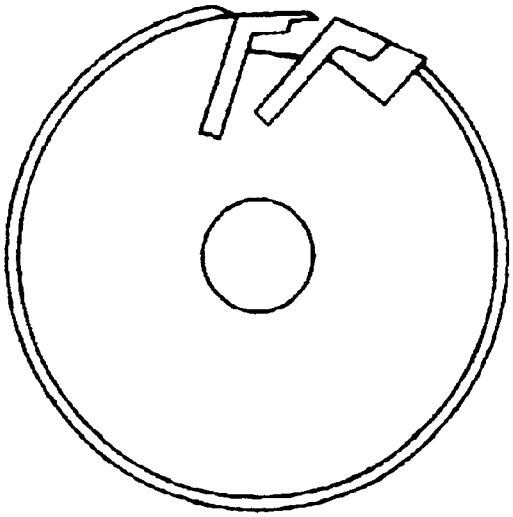

Turning now to the features of blade assembly 10 in more detail, virtual convexly-curved contact profile 24 preferably corresponds to at least part of a virtual cylinder. Preferred ranges of radius of curvature are between about 4 mm and about 30 mm. The optimal radius of curvature is a function of the number of blades to be used. For a single blade (FIG. 14A), the optimal radius of curvature is preferably between about 4 mm and about 6 mm. In a two-blade implementation (FIG. 14B), between about 4.5 mm and about 7 mm is preferred. In the case of a three-blade implementation, the optimal radius of curvature is preferably between about 6 mm and about 15 mm. A curvature of radius greater than about 30 mm is typically not sufficiently convex to cause effective stretching of the skin.

The use of substantially cylindrical contact surfaces provides added advantages of relative insensitivity to the angle at which the razor is held relative to the user's skin. Since the skin conforms to the curvature of the contact profile around a given angular extent of the blade assembly, the skin surface is always tangential to the adjacent portion of the blade assembly. As a result, one or more blade remains in effective cutting relation to the skin surface over a wide range of angles. Thus, the contact surfaces preferably span at least about 30°, and most preferably, at least about 45°, of the virtual cylinder. Particularly for smaller radii of curvature (less than about 10 mm) this offers a corresponding range of holding angles which will still provide an effective cutting geometry between the blade and the skin. It follows that the pivot mechanisms required by most conventional blade assemblies to ensure proper alignment with the skin surface are typically not necessary.

While the blade assembly is described as having at least one blade 12, certain preferred embodiments employ at least two or, as in the example illustrated, three or more blades 12 positioned one behind the next. The use of multiple blades has a particular synergy with the convex contact profile of the present invention, as will now be described.

For convenience of reference, the three blades illustrated are identified individually in FIG. 2 by reference signs 12*a*, 12*b* and 12*c*. Since the blades at different positions around contact profile 24, each blade 12*a*, 12*b* and 12*c* has a different cutting direction, denoted 32*a*, 32*b* and 32*c*, respectively. Depending upon the curvature of the contact profile and the spacing of the blades, the cutting directions of adjacent blades may differ by anything from only a few degrees up to tens of degrees. Preferably, these parameters and/or the number of blades are chosen to ensure that the cutting directions of at least the two outermost blades, in this case 12*a* and 12*c*, are rotated relative to each other by at least about 15°, and most preferably, by at least about 30°. This further extends the range of holding angles over which blade assembly 10 operates properly since, over a wide range of angles, one or more blade remains in effective cutting relation to the skin surface.

Where two or more blades 12 are employed, blade assembly 10 typically also features an intermediate skin guide 34 located between the blades. Intermediate skin guide 34 is configured to provide one or more intermediate contact surface 36 lying on virtual convexly-curved contact profile 24 for contacting the skin 26 of the user.

Turning now to the structure of skin guides 16, 18 and, when present, 34, these may assume a range of forms generally similar to the analogous elements in conventional blade assemblies, differing primarily in their convex form. In a simplest implementation, they provide smooth-surfaced contact surfaces of the required forms. However, in certain preferred implementations, at least leading skin guide 16 is configured to provide a number of front contact surfaces 20 implemented as front contact ridges substantially adjacent to, and spaced along a length of, cutting edge 12.

Front contact ridges 20 provide a particularly advantageous safety blade configuration. The phrase "safety blade" is used in this context to denote a cutting geometry in which the skin guides define the angle and position of the blade relative to the skin surface such that it can be drawn across in direct contact with a regular area of the skin without cutting into the skin. As with any exposed blade device, local irregularities of the skin surface may lead to small cuts where the skin projects outwards. However, the safety blade structure ensures that any such cuts are limited to minimal depth.

In this case, front contact ridges 20 are configured to lie slightly above the cutting plane at positions spaced along the cutting edge so as to prevent the blade from cutting the skin. In the preferred substantially cylindrical contact profile referred to above, this is equivalent to slight lowering of blade 12 so that cutting edge 14 lies just below the contact profile.

The effect of this structure of spaced ridges is to lift small spaced-apart regions of the skin above the cutting plane of the blade. The spacing of the ridges is chosen such that the flexibility of the skin allows the regions not directly supported by ridges 20 to come into contact with the intermediate parts of the blade between the ridges while preventing cutting into the skin.

Front contact ridges 20 are described as being positioned "substantially adjacent to" the cutting edge 14. In this context, any configuration of ridges which extends sufficiently close to the cutting edge to maintain a safe but effective alignment of the blade relative to the skin of a user is described herein as "substantially adjacent". In practice the spacing between the ridges and the cutting edge is preferably no more than a few millimeters and typically much smaller. There is no lower limit to the desired spacing such that the ridges and the cutting edge may be in direct contact.

It will be apparent that the effectiveness of the safety configuration and the closeness of the shave may be adjusted by varying the different parameters defining the cutting geometry. By way of example, typical ranges for some of the parameters are as follows: the height of the skin guide ridges above the cutting plane is typically between about 0.05 and about 1 mm; the spacing between adjacent ridges measured along the cutting edge is typically between about 1.5 and about 5 mm; and the spacing between the ridges and the cutting edge is typically less than about 1 mm.

Where intermediate skin guide 34 is used, intermediate contact surfaces 36 are preferably also implemented as a number of intermediate contact ridges substantially adjacent to, and spaced along a length of, the following cutting edge. In this case, the positions of intermediate contact ridges 36 along the length of the blades are preferably staggered relative to those of front contact ridges 20. This helps to ensure even shaving across the entire width swept by blade assembly 10 in a single stroke.

Structurally, the various skin guides are preferably all integrally formed or rigidly interconnected to form a unified structure. In the case illustrated here, this structure has an overall roughly cylindrical shape. The parts of the cylinder adjacent to the region in contact with the skin (i.e., within a total angular range of up to about 90°) become functional when the angle at which the razor is held varies, while the part of the cylinder facing away from the skin is clearly functionally unimportant as can be seen from FIG. 3. Intermediate skin guide 34 is typically attached to the rest of the structure at least near the sides of blade assembly 10, and may also be connected to the blade-holding structure at one or more positions along the length of the blades. The blade assembly structure is preferably unified by a retaining ring 44 attached at each end so as to overlie the blades 12. For convenience of description, blade assembly 10 is shown in FIG. 1 with one retaining ring removed.

Another preferred feature of blade assembly 10 is that it is formed with a number of drainage channels 40 formed between each blade 12 and the skin guide immediately ahead of the blade. Where the skin guide has the preferred ridge form described above, channels 40 may be primarily beneath the blade, opening to the outside via the spaces between adjacent ridges. In open-backed implementations as will be described below with reference to FIGS. 10–13, channels 40 preferably open directly to the back of assembly 10. In the roller-shaped implementations of FIGS. 1–9, channels 40 adjacent to each blade preferably open into a central hollow 42. In either case, the resulting structure can easily be cleaned by flushing out with water after use.

It will be appreciated that blade assembly 10 may be made from a wide range of materials. The blades themselves are typically made from steal or other metal alloys known to be suitable for this purpose. Examples of materials suitable for the remaining parts of blade assembly 10 include, but are not limited to, metals and metal alloys of various kinds, plastics and other polymer materials, and any combinations thereof.

Turning now to FIGS. 4–11, a number of variations of blade assembly 10 will now be described. Each of the variations is to a large extent similar to blade assembly 10 as described above. For brevity, only those features in which each variation differs from blade assembly 10 will be described.

Figure 4:
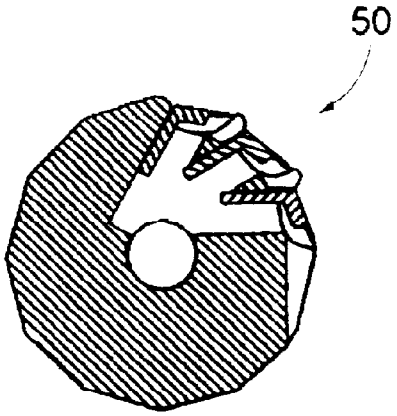
FIG. 4 is a cross-sectional view of a first variation of the blade assembly of FIG. 1.

Turning first to FIG. 4, there is shown a first variation 50 of blade assembly 10. Blade assembly 50 differs from blade assembly 10 in that a number of planar contact surfaces are used to approximate to parts of convexly-curved contact profile 24. This approximation is acceptable so long as the overall effect is of a convex curvature formed to generate a corresponding concave curvature in the user's skin in the region of the cutting edges. For the purposes of the description and claims, this structure is also described as lying substantially on a virtual convexly-curved contact profile.

Figure 5:
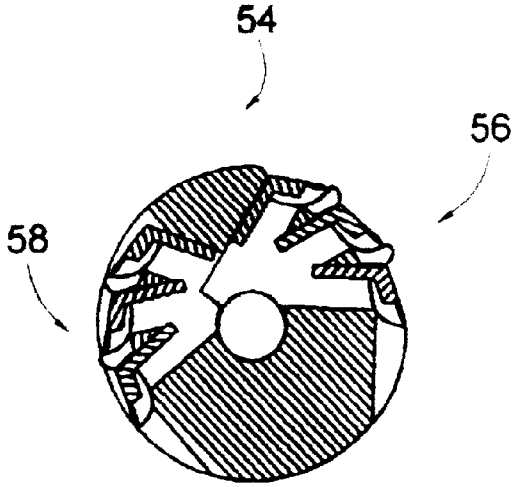
FIG. 5 is a cross-sectional view of a second variation of the blade assembly of FIG. 1.

Turning now to FIG. 5, this shows a second variation 54 of blade assembly 10. Blade assembly 54 is a two sided version of blade assembly 10 which provides anterior and posterior sub-assemblies 56 and 58, each having one or more blade. Each sub-assembly includes substantially all of the features of blade assembly 10 described above. This configuration allows the user to switch direction of shaving or to move from one side of the face to the other without shifting his hold on the razor.

Figure 6:
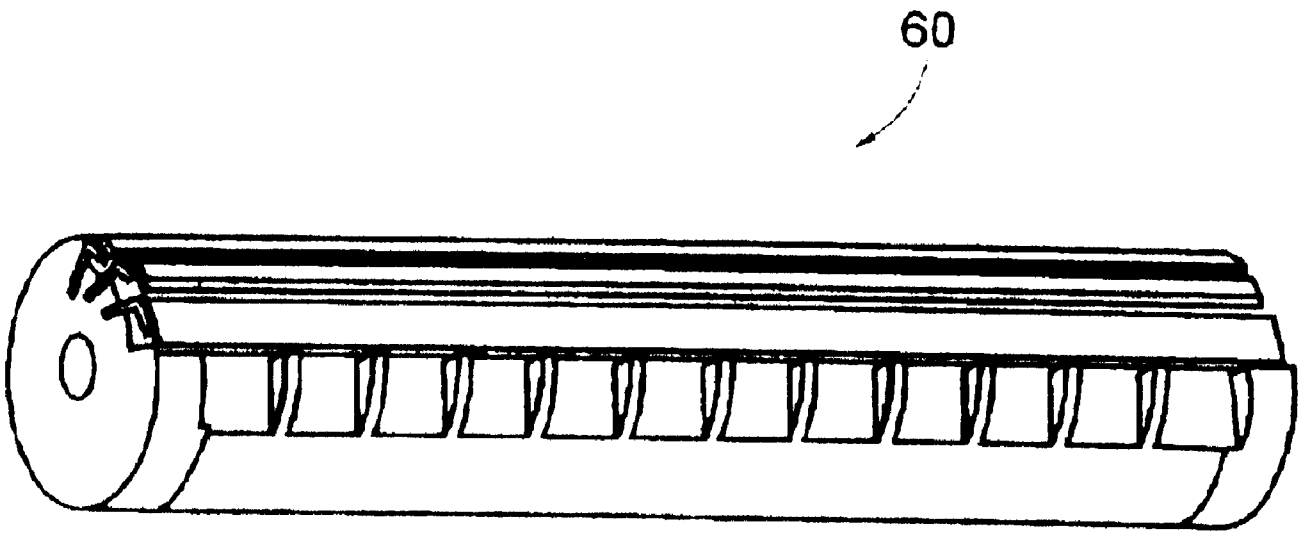
FIG. 6 is an isometric view of a third variation of the blade assembly of FIG. 1.
Figure 7:
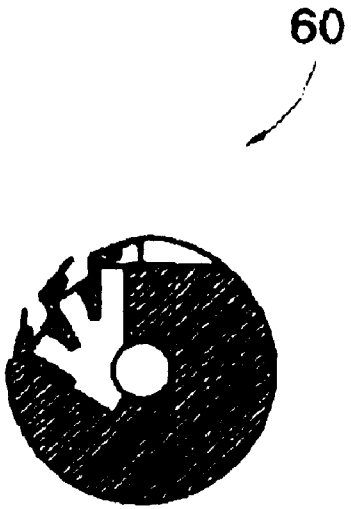
FIG. 7 is a cross-sectional view taken through the blade assembly of FIG. 6.

Turning now to FIGS. 6–8, there is shown a third variation 60 of blade assembly 10. Blade assembly 60 differs from blade assembly 10 by the omission of intermediate skin guides 34. Instead, the geometry of each blade is fixed so that it provides a safety configuration.

Specifically, with reference to FIG. 8, each blade, and particularly the blades not adjacent to leading skin guide 18, are positioned so as to have a negative attack angle $\alpha$ as defined above. Typically, an angle of as little as $-0.5°$ together with correct vertical positioning of the blade is sufficient to ensure that the blade will not cut into the skin.

Figure 9:
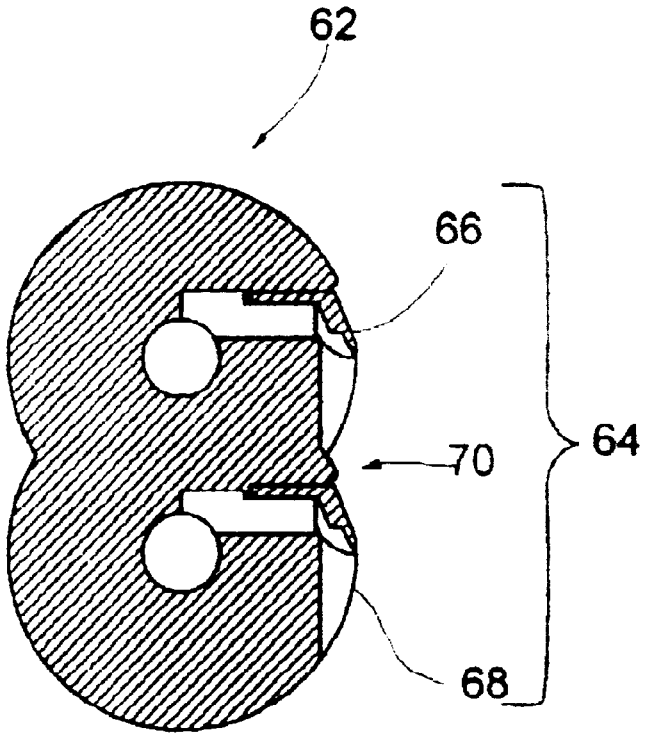
FIG. 9 is a cross-sectional view of a fourth variation of the blade assembly of FIG. 1.

Turning now to FIG. 9, there is shown a fourth variation 62 of blade assembly 10. In this context, it should be noted that the convexly-curved contact profile of the present invention need not be uniform or even continuously convex along the front of the blade assembly. Thus, blade assembly 62 exhibits a double-cylinder type shape in which two blades 12 are located at different points along a complex contact profile 64. Contact profile 64 includes two convexly-curved portions 66 and 68 joined by an intermediate concavity 70. Since each blade is set between leading and trailing skin guides which define locally convexly-curved contact profiles, the structure and operation of blade assembly 62 remains analogous to that of blade assembly 10 described above.

Figure 10:
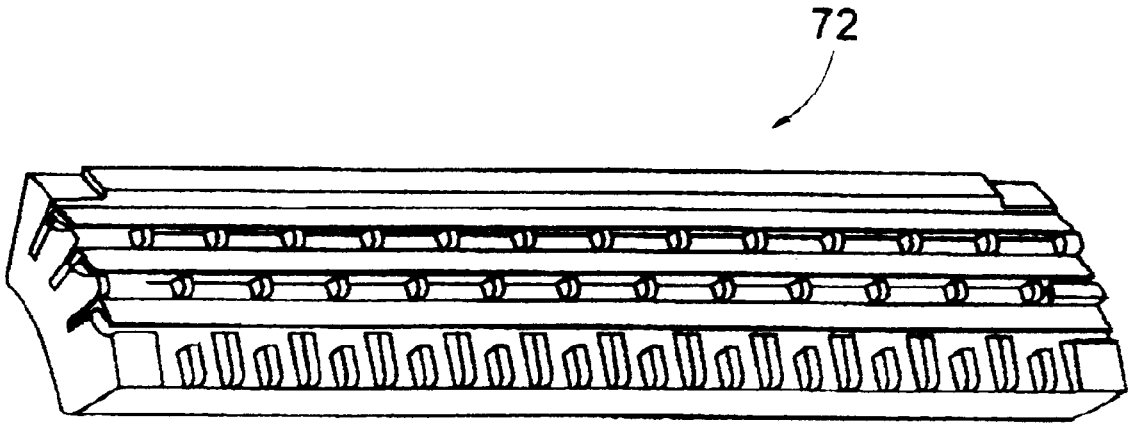
FIG. 10 is an isometric view of a fifth variation of the blade assembly of FIG. 1.
Figure 11:
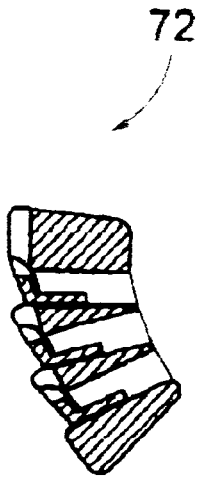
FIG. 11 is a cross-sectional view taken through the blade assembly of FIG. 10.

Turning now to FIGS. 10 and 11, there is shown a fifth variation 72 of blade assembly 10. As mentioned earlier, the cylindrical form of blade assembly 10 other than in the regions around the blades is not important to the operation of the razor. Thus, blade assembly 72 illustrates an open-backed implementation of a blade assembly otherwise closely paralleling the structure of blade assembly 10. This open-backed implementation has particular advantages of compactness, especially where a relatively large radius of curvature is preferred.

Figure 12:
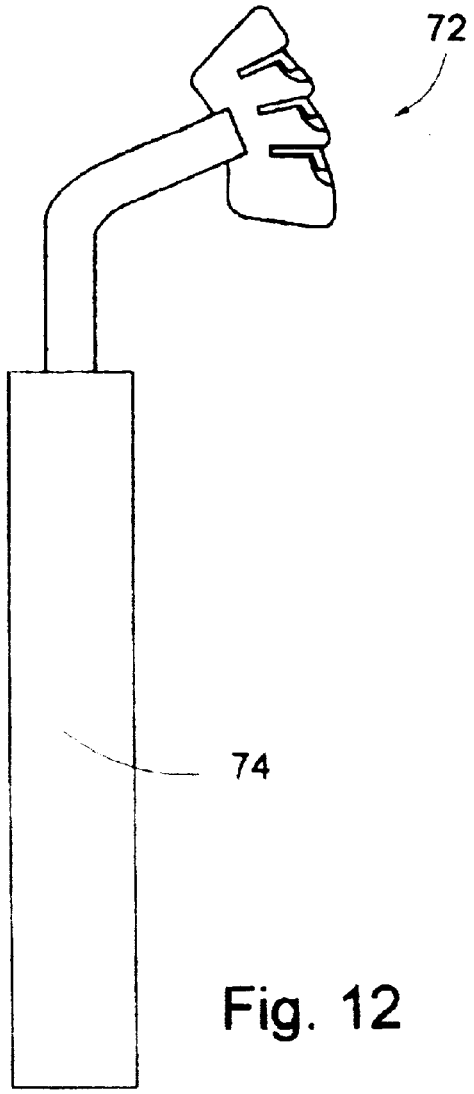
FIG. 12 is a side view of a razor employing the blade assembly of FIG. 10.

Turning now to FIG. 12, it should be noted that all implementations of a blade assembly described above may be used in any type of manual razor. By way of example, FIG. 12 shows blade assembly 72 attached to a handle 74. Preferably, the blade assembly is implemented as a removable cartridge configured for removable attachment to the handle by any conventional mechanism. Optionally, pivotal movement may be provided, either by hinged connection to the handle, or by provision of an integral hinge portion within the handle itself (not shown).

Figure 13:
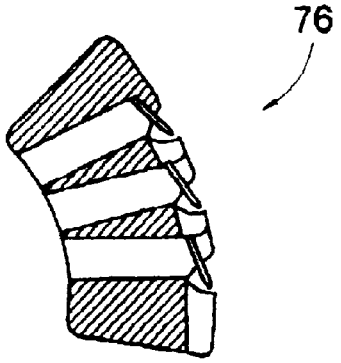
FIG. 13 is a view similar to FIG. 11 showing an implementation employing an alternative type of blade.

Finally, referring briefly to FIG. 13, it should be appreciated that the present invention may be implemented using any desired blade type. By way of example, the implementations described above have employed L-configuration blades. However, other blade types such as flat-configuration blades, may equally be used. Thus, FIG. 13 shows a blade assembly 76 generally similar to blade assembly 72 but employing flat-configuration blades.

It will be appreciated that the above descriptions are intended only to serve as examples, and that many other embodiments are possible within the spirit and the scope of the present invention.

What is claimed is:

1. A razor for shaving hair from the skin of a user, the razor comprising a blade assembly including:

(a) at least two blades, each having a cutting edge;

(b) a leading skin guide located ahead of said cutting edges, said leading skin guide being configured to provide at least one front contact surface for contacting the skin of a user;

(c) an intermediate skin guide located between said cutting edges and configured to provide at least one intermediate contact surface; and (d) a trailing skin guide located behind said cutting edges, said trailing skin guide being configured to provide at least one rear contact surface for contacting the skin of a user, wherein said front contact surface, said intermediate contact surface and said rear contact surface lie substantially on a virtual convexly-curved contact profile such that, when said blade assembly is pressed against the skin of the user, the skin becomes stretched at least in a region adjacent to said cutting edge to conform to said contact profile so that substantially the entirety of at least two of said cutting edges are in operative shaving relation to the skin simultaneously.

2. The razor of claim 1, wherein said virtual convexly-curved contact profile corresponds to at least part of a virtual cylinder.

3. The razor of claim 2, wherein said virtual cylinder has a radius of between about 4 mm and about 30 mm.

4. The razor of claim 2, wherein said at least two blades are implemented as exactly two blades, said virtual cylinder having a radius of between about 4.5 mm and about 7 mm.

5. The razor of claim 2, wherein said at least two blades are implemented as at least three blades, said virtual cylinder having a radius of between about 6 mm and about 15 mm.

6. The razor of claim 2, wherein said at least part of said virtual cylinder corresponds to an angular extent of at least about 30°.

7. The razor of claim 2, wherein said at least part of said virtual cylinder corresponds to an angular extent of at least about 45°.

8. The razor of claim 1, wherein a tangent to said virtual convexly-curved contact profile taken adjacent to said cutting edge of a first of said blades defines a first cutting direction and a tangent to said virtual convexly-curved contact profile taken adjacent to said cutting edge of a second of said blades defines a second cutting direction, said second cutting direction being rotated by at least about 15° from said first cutting direction.

9. The razor of claim 1, wherein said leading skin guide is configured to provide a plurality of said front contact surfaces implemented as front contact ridges substantially adjacent to, and spaced along a length of, said cutting edge.

10. The razor of claim 9, wherein said blades are referred to as a first blade and a second blade, said intermediate skin guide being configured to provide a plurality of intermediate contact ridges substantially adjacent to, and spaced along a length of, said cutting edge of said second blade, wherein positions of said intermediate contact ridges are staggered relative to positions of said front contact ridges.

11. The razor of claim 1, wherein said blade assembly is formed with at least one drainage channel formed between said at least one blade and at least one of said leading skin guide and said trailing skin guide.

12. The razor of claim 1, further comprising a handle, wherein said blade assembly is implemented as a removable cartridge configured for attachment to said handle.

13. A razor for shaving hair from the skin of a user, the razor comprising a blade assembly including:

(a) at least one blade having a cutting edge defined at least in part by a grinding plane to which said blade is ground, (b) a leading skin guide located ahead of said cutting edge, said leading skin guide being configured to provide at least one front contact surface for contacting the skin of a user; and (c) a trailing skin guide located behind said cutting edge, said trailing skin guide being configured to provide at least one rear contact surface for contacting the skin of a user, wherein said front contact surface and said rear contact surface lie substantially on a virtual convexly-curved contact profile such that, when said blade assembly is pressed against the skin of the user, the skin becomes stretched at least in a region adjacent to said cutting edge to conform to said contact profile, and wherein said grinding plane is angled relative to said contact profile such that said cutting edge has a negative attack angle.

* * * * *